US009675214B2

(12) United States Patent
Johnson

(10) Patent No.: US 9,675,214 B2
(45) Date of Patent: Jun. 13, 2017

(54) OVERSIZED BATH PILLOW

(71) Applicant: Celtie Leigh Johnson, Prairie Village, KS (US)

(72) Inventor: Celtie Leigh Johnson, Prairie Village, KS (US)

( * ) Notice: Subject to any disclaimer, the term of this patent is extended or adjusted under 35 U.S.C. 154(b) by 0 days.

(21) Appl. No.: 15/059,014

(22) Filed: Mar. 2, 2016

(65) Prior Publication Data

US 2016/0287026 A1 Oct. 6, 2016

Related U.S. Application Data

(60) Provisional application No. 62/141,151, filed on Mar. 31, 2015.

(51) Int. Cl.
*A47K 3/024* (2006.01)
*A47K 3/12* (2006.01)
*A47G 9/10* (2006.01)

(52) U.S. Cl.
CPC ..... *A47K 3/125* (2013.01); *A47G 9/10* (2013.01); *A47G 2009/1018* (2013.01)

(58) Field of Classification Search
CPC ..... A47K 3/125
USPC ..... 4/538–596
See application file for complete search history.

(56) References Cited

U.S. PATENT DOCUMENTS 5,140,713 A * 8/1992 Pesterfield ..... A47K 3/125 4/575.1
5,279,237 A * 1/1994 Alivizatos ..... A47K 3/001 112/475.05
5,535,458 A * 7/1996 Siverly ..... A47K 3/122 4/573.1
5,819,333 A * 10/1998 Coleman ..... A47K 3/06 4/538
5,829,070 A * 11/1998 Taylor ..... A47K 3/125 4/578.1
6,804,842 B1 * 10/2004 Johnson ..... A47K 3/125 4/578.1
6,993,797 B1 * 2/2006 Yang ..... A47K 3/125 4/575.1
7,472,432 B2 * 1/2009 Owen ..... A47K 3/125 4/573.1
2007/0214561 A1 * 9/2007 Brooks ..... A47K 3/125 4/575.1
2008/0148472 A1 * 6/2008 Cline ..... A47K 3/125 4/575.1
2009/0025137 A1 * 1/2009 Otermans ..... A47K 3/125 4/575.1
2011/0131721 A1 * 6/2011 Kobzan ..... A47K 3/125 4/575.1

(Continued)

*Primary Examiner* — Lori Baker
(74) *Attorney, Agent, or Firm* — Plager Schack LLP

(57) ABSTRACT

A bathtub pillow for reducing a volume of water necessary for filling a bathtub and for providing support and comfort to a user's back, shoulders, neck, and head may include an outer shell defining an interior of the pillow, the outer shell having a front side, a backside, a left side, a right side, a top surface, and a bottom surface; a conformable filler filling the interior of the pillow; and a fastener attached to a surface of the pillow, the fastener being configured to removably attach to a surface of the bathtub. The pillow may be shaped to provide support to a user's back, shoulders, neck, and head. For example, the pillow may be vase shaped.

7 Claims, 4 Drawing Sheets

(56) References Cited

U.S. PATENT DOCUMENTS

2014/0359932 A1* 12/2014 Dutton ..... A47K 3/127
4/572.1

* cited by examiner

FIG.4
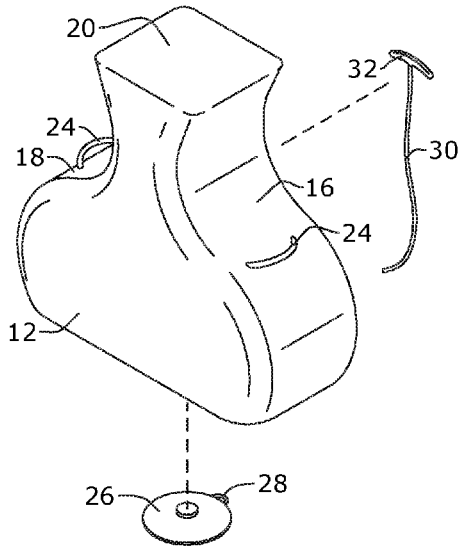
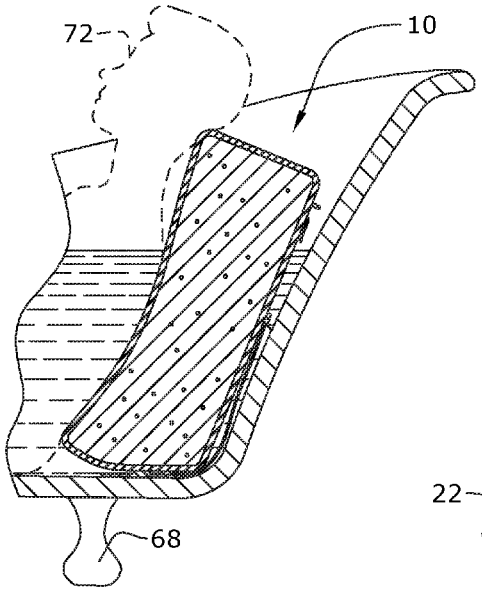
FIG.5
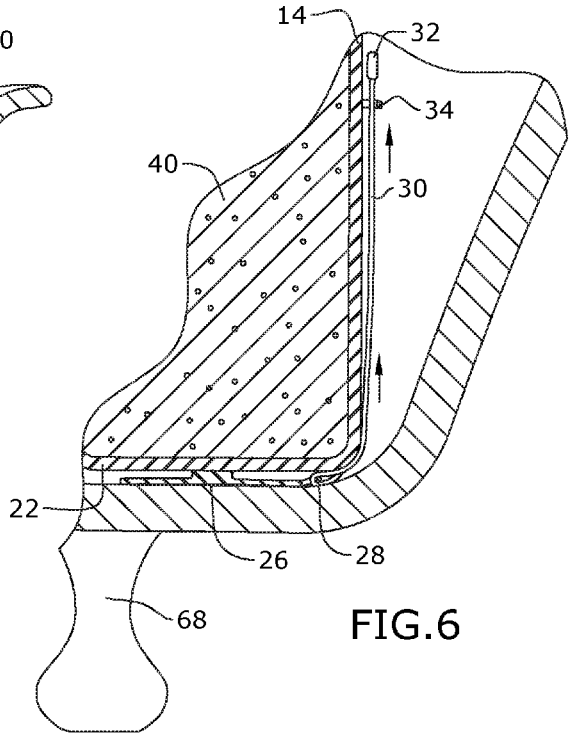
FIG.6

FIG.7
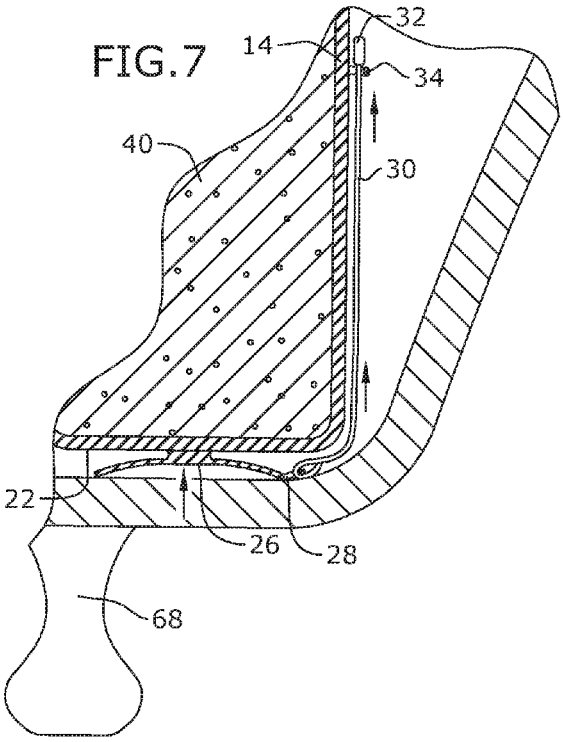
FIG.8
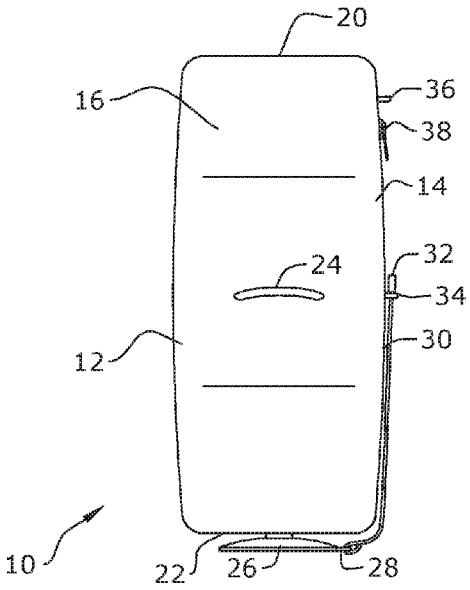
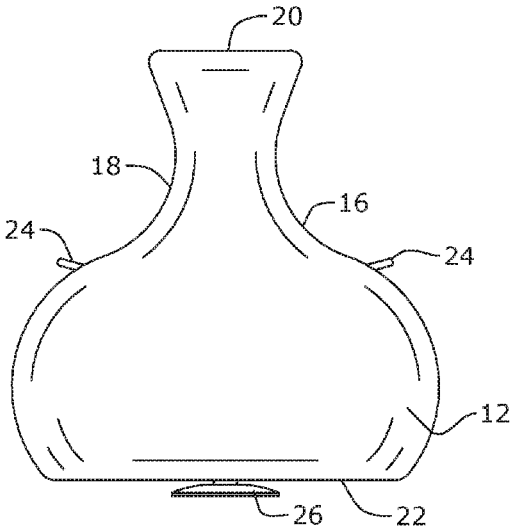
FIG.9
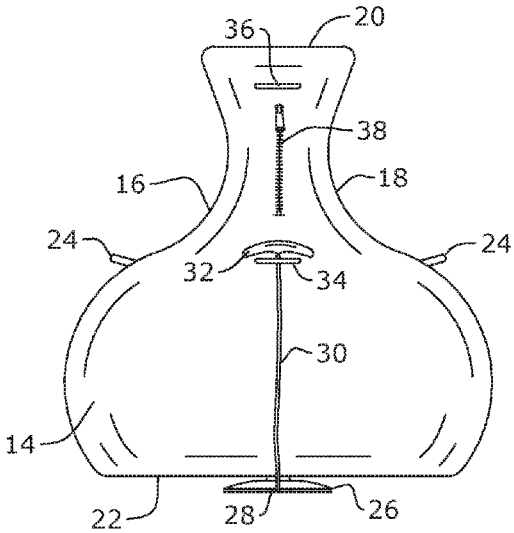
FIG.10

FIG.11
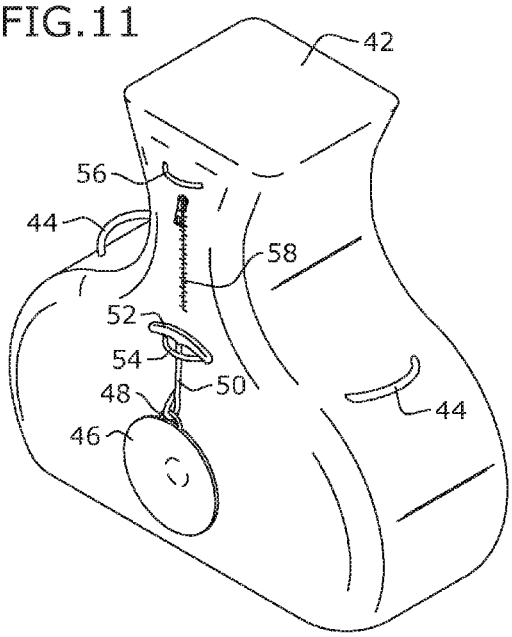
FIG.12
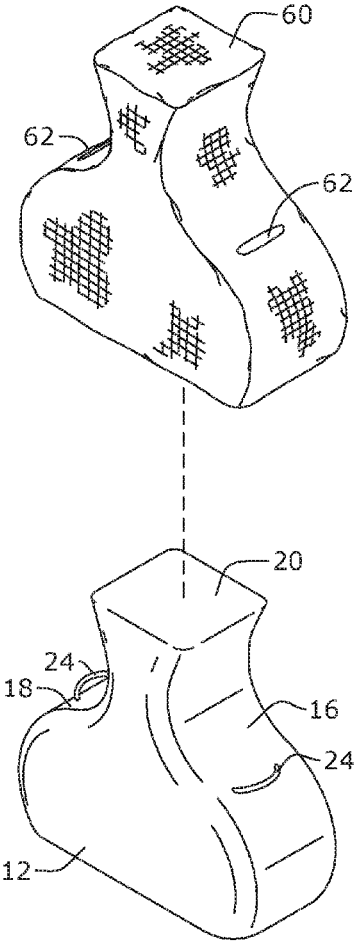
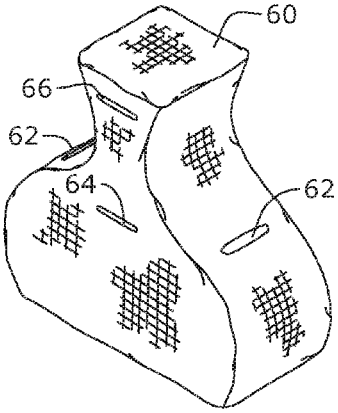
FIG.13

OVERSIZED BATH PILLOW

RELATED APPLICATION

This application claims priority to provisional patent application U.S. Ser. No. 62/141,151 filed on Mar. 31, 2015, the entire contents of which is herein incorporated by reference.

BACKGROUND

The embodiments herein relate generally to bathing accessories, and more particularly, to a multipurpose, oversized bath pillow.

Water has become a more and more in demand resource, resulting in water shortages throughout the nation and the world. Many technology areas are implementing water saving devices to decrease the amount of water necessary for performing a task. However, little has been done to conserve water for people wanting to take a bath. Rather, to save water a bather may simply not fill the tub as full, which results in a bather not being able to completely submerge in the bathtub. Filling a conventional bathtub takes about 55 gallons of water per bath.

When taking a bath, bathers often use bath pillows to increase their comfort in the bathtub. Conventional bathtub pillows are placed between the bather and the end of the tub. However, conventional bath pillows are typically small without ample cushioning and provide inadequate support to no support on a bather's lower back, shoulders, neck, and head. When bathing, some people desire to have their back supported by one end of the tub and their feet touching the opposite end for stability, but many people are too short to recline and soak effortlessly.

Therefore, what is needed is a bathtub pillow that is configured to provide ample support to a user's body and, at the same time, reducing the amount of water needed to fill the bathtub to an adequate depth.

SUMMARY

Some embodiments of the present disclosure include a bathtub pillow for reducing a volume of water necessary for filling a bathtub and for providing support and comfort to a user's back, shoulders, neck, and head. The pillow may include an outer shell defining an interior of the pillow, the outer shell having a front side, a backside, a left side, a right side, and a bottom surface; a conformable filler filling the interior of the pillow; and a fastener attached to a surface of the pillow, the fastener being configured to removably attach to a surface of the bathtub. The pillow may be shaped to provide support to a user's back, shoulders, neck, and head. For example, the pillow may be vase shaped.

BRIEF DESCRIPTION OF THE FIGURES

The detailed description of some embodiments of the invention is made below with reference to the accompanying figures, wherein like numerals represent corresponding parts of the figures.

FIG. 4 is an exploded view of one embodiment of the present disclosure.

FIG. 5 is a section view of one embodiment of the present disclosure, taken along line 5-5 in FIG. 1.

FIG. 6 is an enlarged section view of one embodiment of the present disclosure.

FIG. 7 is an enlarged section view of one embodiment of the present disclosure.

FIG. 8 is a side view of one embodiment of the present disclosure.

FIG. 9 is a front view of one embodiment of the present disclosure.

FIG. 10 is a back view of one embodiment of the present disclosure.

FIG. 11 is perspective view of one embodiment of the present disclosure.

FIG. 12 is an exploded view of one embodiment of the present disclosure.

FIG. 13 is a perspective view of one embodiment of the present disclosure.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to reduce the amount of water needed to fill a tub, while also providing ample support to a user's body and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Pillow
2. Fastener

The various elements of the device of the present disclosure may be related in the following exemplary fashion. It is not intended to limit the scope or nature of the relationships between the various elements and the following examples are presented as illustrative examples only.

Figure 1:
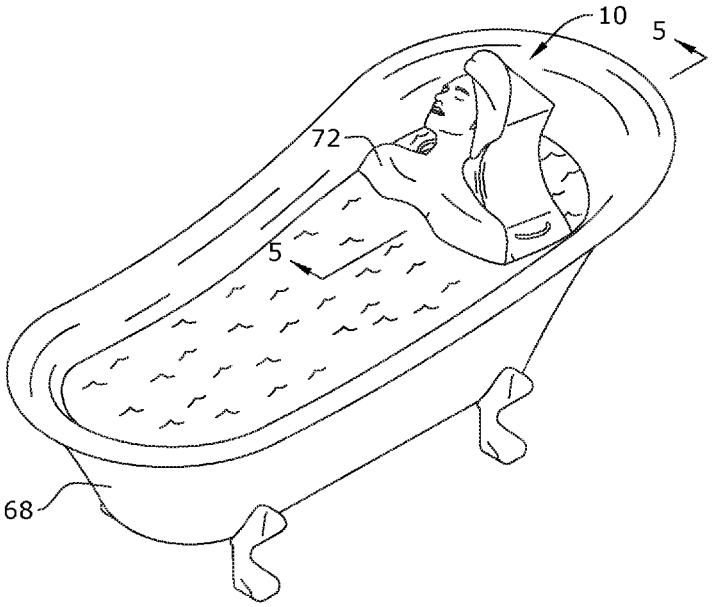
FIG. 1 is a perspective view of one embodiment of the present disclosure.
Figure 2:
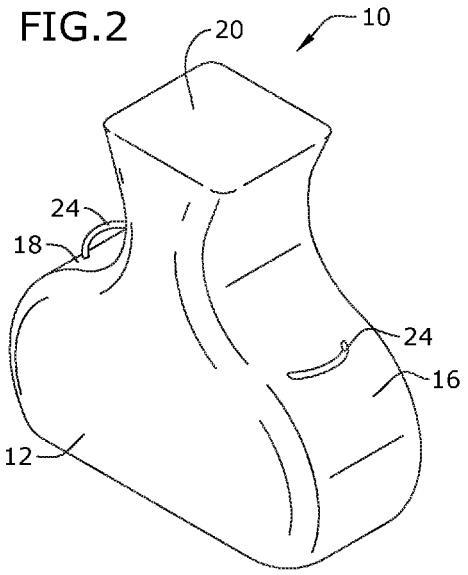
FIG. 2 is a front perspective view of one embodiment of the present disclosure.
Figure 3:
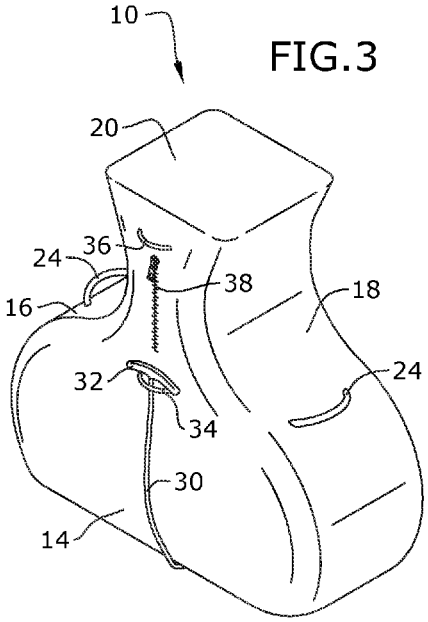
FIG. 3 is a back perspective view of one embodiment of the present disclosure.

By way of example, and referring to FIGS. 1-13, some embodiments of the present disclosure include a bathtub pillow 10 for reducing the amount of water necessary to fill a bathtub, while also providing ample support to a user's body, the bathtub pillow 10 comprising an outer shell comprising a front side 12; a backside 14 opposite the front side 12; a left side 18 connecting the front side 12 and the backside 14; a right side 16 opposite the left side 18, the right side 16 also connecting the front side 12 and the backside 14; a top surface 20, the top surface 20 connecting the front side 12, the backside 14, the left side 18, and the right side 16; and a bottom surface 22 opposite the top surface 20, the bottom surface 22 connecting the front side 12, the backside 14, the left side 18, and the right side 16; and a fastener 26 attached to the bottom surface 22 of the pillow 10, the fastener 26 configured to removably attach to a surface of a bathtub 68. The backside 14 of the pillow 10 may be configured to face an end of the bathtub 68, while the front side 12 may represent the side that is facing a user 72.

The outer shell of the pillow 10 may be configured to accommodate a volume of a filler 40. The filler may be any suitable filler material, such as water, air, feathers, bubble-wrap, a sold foam piece, shredded foam, and the like. When the filler 40 comprises shredded foam, the pillow 10 may provide ample support and comfort to a user 72, while also being durable enough to last over repetitive uses. Shredded foam may conform to a user's back, resulting in support, including lumbar support, being provided throughout the back, shoulders, neck, and head.

The fastener 26 may be any fastener suitable for removably securing the pillow 10 to a surface of a bathtub 68. For example, as shown in the Figures, the fastener 26 may be a suction cup. In embodiments, there may be multiple fasteners, such as a plurality of suction cups, attached to a surface of the pillow 10. The fastener 26 may have a fastener loop 28 attached to a release rope 30 that runs up the backside 14 of the pillow 10. An end of the release rope 30 distal from the fastener loop 28 may comprise a release handle 32. When the release handle 32 is pulled by a user, the fastener 26 may unattach from the surface of the bathtub 28. For example, in the case of a suction cup, pulling on the release handle 32 may cause the release rope 30 to pull on the suction cup, breaking the vacuum suction seal of the suction cup to the tub 28. The backside 14 of the pillow 10 may also comprise a retaining strap 34 configured to hold the release handle 32 and release rope 30 adjacent to the backside 14 of the pillow 10.

The backside 14 of the pillow 10 may also comprise a drying strap 13 configured to engage with a hook or other protrusion to hang the pillow 10 to, for example, allow the pillow 10 to dry or to be stored out of the way. Additionally, the backside 14 may include a filler access opening 38, which may be securely closed using a fastener, such as a zipper. The opening 38 may be capable of closing, creating a watertight seal, such that no water can enter an interior portion of the pillow 10 through the opening 38 when it is closed. While the above optional features have been described as being positioned on the backside 14 of the pillow 10, any surface of the pillow 10 may include these features. Also, each of the left side 18 and the right side 16 may comprise a lift handle 24. The lift handles 24 may aid a user in moving the pillow 15.

Instead of including a fastener on a bottom surface of the pillow, an alternative embodiment includes a pillow 42 having a fastener 46, such as a suction cup, positioned on a backside of the pillow rather. Such embodiments may comprise a fastener loop 48 attached to a release rope 50 with a release handle 52, wherein a retaining strap 54 is configured to keep the release rope 50 and release handle 52 adjacent to the backside of the pillow 42. Similar to the earlier described embodiment, the alternate backside may also comprise a filler access opening 58 and a drying strap 56. The alternate embodiment may also comprise lift handles 44 positioned on the left and right sides of the pillow 42, as shown in FIG. 11.

The pillow may also comprise a cover 60 configured to envelope the pillow 10, as shown in FIGS. 12 and 13. The cover 60 may mimic the shape of the pillow 10 and may comprise lift handle openings 62 through which the lift handles 24 may extend, a retaining strap and release handle opening 64 through which the restraining strap 34 and release handle 32 may extend, and a drying strap opening 66 through which the drying strap 36 may extend.

The outer shell of the pillow may be made of any suitable material, and, in embodiments, is made of a waterproof liner, which prevents water from entering the interior of the pillow. If water enters the interior of the pillow, the filler could get wet, ruining the quality of the filler, or mold and/or mildew could form. Similarly, the cover may be any material suitable for adding comfort or style to the pillow, such as any cloth material and, in embodiments, may be made from a terrycloth material. When present, the cover may either attach to the outer shell using a conventional fastener, such as Velcro, or it may simply slip over the pillow, while still enabling the fastener on the bottom surface or back surface to be used.

The pillow may have any suitable shape, such as round, square, wedge, pear-shapes, egg-shaped, and rectangular, and, in embodiments, has a vase-like shape, as shown in FIGS. 1-13, wherein a bottom portion of the pillow curves outward to provide lumbar support to a user's lower back and an upper portion of the pillow narrows. When the pillow has the vase-like shape, it may fit closely with the width and shape of a conventional bathtub. The top surface of the pillow may be substantially flat and may support light-weight items, such as a book.

The pillow may have any width suitable for fitting within the width of a bathtub and, in embodiments, fits snugly between the two longer sides of a bathtub. For example, the pillow may be about 24 inches wide. The pillow may have any height suitable for supporting a user's back, shoulders, neck, and head and, in embodiments, may be about 24 inches tall. The length of the pillow, or the distance between the front side and the backside, may be any size, such as, for example, from about 10 inches to about 20 inches. Thus, two embodiments of the pillow may be a first pillow having dimensions of about 10 inches long, about 24 inches wide, and about 24 inches tall and a second pillow having dimensions of about 20 inches long, about 24 inches wide, and about 24 inches tall. Because of the size of the pillow, the pillow may have the ability to take up room that would typically be taken up by water, thereby reducing the amount of water necessary for taking a bath. For example, the pillow may consume up to about 4 cubic feet of the bathtub volume, saving many gallons of water. The pillow may also effectively reduce the length of a tub, resulting in users being able to relax with their back propped against the pillow and their feet touching the opposite end of the tub. Specifically, Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bathtub pillow for reducing a volume of water necessary for filling a bathtub and for providing support and comfort to a user's back, shoulders, neck, and head, the pillow comprising:

an outer shell defining an interior of the pillow, the outer shell comprising a front side, a backside, a left side, a right side, a top surface, and a bottom surface;

a conformable filler filling the interior of the pillow;

a suction cup attached to the bottom surface of the pillow, the suction cup being configured to removably attach to a surface of the bathtub;

a release rope attached to a loop on the suction cup;

a release handle positioned on an end of the release rope distal from the suction cup; and a retaining strap on the backside of the pillow, the retaining strap configured to hold the release rope and the release handle adjacent to the backside of the pillow, wherein:

the pillow has a shape configured to provide support to a user's back, shoulders, neck, and head; and when the release handle is pulled by a user, the suction cup unattaches from the surface of the bathtub.

2. The bathtub pillow of claim 1, further comprising a first lift handle attached to the left side and a second lift handle attached to the right side.

3. The bathtub pillow of claim 1, further comprising a drying strap attached to the backside.

4. The bathtub pillow of claim 1, wherein the pillow has a vase-like shape such that a bottom portion of the pillow curves outward and an upper portion of the pillow narrows.

5. The bathtub pillow of claim 1, wherein the conformable filler is a shredded foam.

6. The bathtub pillow of claim 1, further comprising a cover configured to envelope the pillow.

7. The bathtub pillow of claim 1, wherein the bathtub pillow consumes about 4 cubic feet of a bathtub when placed in the bathtub.

* * * * *